US007537088B2

(12) United States Patent
Spitsbergen

(10) Patent No.: US 7,537,088 B2
(45) Date of Patent: May 26, 2009

(54) PORTABLE HOIST ASSEMBLY MOUNTING SYSTEMS AND METHODS

(76) Inventor: Michael Spitsbergen, PO Box 3423, Ramona, CA (US) 92065

( * ) Notice: Subject to any disclaimer, the term of this patent is extended or adjusted under 35 U.S.C. 154(b) by 0 days.

(21) Appl. No.: 11/637,560

(22) Filed: Dec. 12, 2006

(65) Prior Publication Data

US 2007/0131636 A1 Jun. 14, 2007

Related U.S. Application Data

(60) Provisional application No. 60/749,436, filed on Dec. 12, 2005.

(51) Int. Cl.
*B66B 9/16* (2006.01)
*B66C 23/18* (2006.01)

(52) U.S. Cl. ..... 187/242; 187/240; 187/241; 212/179

(58) Field of Classification Search ..... 212/179; 187/240, 241, 242, 243, 244; 248/327
See application file for complete search history.

(56) References Cited

U.S. PATENT DOCUMENTS

| | | | | |
|---|---|---|---|---|
| 6,135,300 | A * | 10/2000 | Fox | 212/179 |
| 6,478,172 | B2 * | 11/2002 | Zingerman | 212/179 |
| 6,983,156 | B2 * | 1/2006 | Fukushima et al. | 455/456.1 |
| 7,044,313 | B2 * | 5/2006 | Haliburda, III | 212/179 |
| 7,407,039 | B2 * | 8/2008 | Bailey | 187/240 |

* cited by examiner

*Primary Examiner*—Patrick H Mackey
*Assistant Examiner*—Terrell H Matthews

(57) ABSTRACT

The systems and methods of the present invention provide support for a holster mounting into which the vertical support of a portable hoist assembly is inserted. Disclosed is a saddle mount for the holster mounting usable on the top of a wall. Also disclosed is a floor supported base and cart assembly for the holster mounting.

4 Claims, 7 Drawing Sheets

PORTABLE HOIST ASSEMBLY MOUNTING SYSTEMS AND METHODS

CROSS REFERENCE TO RELATED APPLICATION

This application claims the benefit of Provisional U.S. Patent Application No. 60/749,436 filed Dec. 12, 2005.

STATEMENT REGARDING FEDERALLY FUNDED RESEARCH AND DEVELOPMENT

The invention described in this patent application was not the subject of federally sponsored research and development.

FIELD

The present invention pertains to a small hand carryable portable hoist assembly used to move small loads short distances. Small loads are those loads that cannot easily be lifted by one or two persons. More particularly, the present invention pertains to systems and methods for mounting a small hand carryable portable lift assembly to increase its utility.

BACKGROUND

Since the portable hoist assembly described in U.S. Pat. No. 6,499,610 was first introduced to the marketplace, it has received a favorable response. However, those needing a small hand carryable portable hoist assembly for moving small loads short distances in either a vertical direction, a horizontal direction or both have expressed a desire to use such a portable hoist assembly in a variety of different applications not contemplated in U.S. Pat. No. 6,499,610.

Exemplary of some situations in which a small hand-carryable portable hoist assembly has been needed include moving roofing materials or small air conditioning units to or from the roof of a building. Similar needs have arisen during work on bridges where a need has arisen to move supplies and equipment up to or down from a bridge surface. Still other needs have arisen within multi-story buildings or factories where a need has arisen to move equipment or supplies from one floor to another floor through an open space within the building.

Yet another need has arisen in small shops where either parts or supplies must be moved short distances in confined spaces. For example, a small machine shop may receive delivery of a small engine assembly to its shop floor for rebuild or repair. In larger machine shops, such small engine assemblies are first placed on a pallet, then a fork lift truck takes the engine where it needs to go. In still other shops overhead cranes are used. But in small shops loads such as engines, must often be placed in locations with limited access before they can be disassembled.

In still another example, a small business may receive deliveries of containers of liquid that weigh in excess of one hundred pounds. Such containers may be typically moved to the location where needed by wagons or carts. However, lifting the containers, moving the containers over the wagon or cart and then lowering the containers onto the wagon or cart from a position on the floor requires the use of a portable hoist assembly.

In yet another example, a large electric motor may have to be removed from a machine for repair or replacement; however, nearby equipment may restrict access to the large electric motor. In such cases there is a need for a portable hoist assembly to lift the large electric motor into a space where it can be moved around other equipment.

Accordingly, a need has arisen in the art for systems and methods for mounting a small hand carryable portable hoist assembly usable for lifting small loads, not easily carried, to increase the utility of the small hand carryable portable hoist assembly.

SUMMARY

The systems and methods of the present invention provide for mounting a small hand carryable portable hoist assembly to enhance its utility.

The systems and methods of the present invention provide a secure support for a mounting holster into which the vertical support of a portable hoist assembly is inserted.

In one embodiment the mounting holster for the portable hoist assembly is affixed to a saddle mount assembly configured for attachment to the top of a wall. Included is a turn over support brace extending from the saddle mount assembly along the top of the wall to counter any turn over moment. The saddle mount is also configured for attachment to a corner portion on the top of the wall.

In another embodiment, a base suitable for providing floor support for the mounting holster for the portable hoist assembly is shown. Turn over support braces are used to counter any turn over moments. The floor support base is configured for use with or without wheels.

In yet another embodiment, the base positioning the mounting holster for the portable hoist assembly is formed as a substantially U shaped movable, floor supported cart

BRIEF DESCRIPTION OF THE DRAWING FIGURES

A better understanding of the portable hoist assembly mounting systems and methods of the present invention may be had by reference to the drawing figures, wherein.

DESCRIPTION OF THE EMBODIMENTS

Since the introduction of the light weight portable hoist assembly described in U.S. Pat. No. 6,449,610 into the market place users have found many applications for the light weight portable hoist assembly. One problem experienced by users has been the lack of a broader array of mounting systems and methods for the light weight portable hoist assembly.

In yet other situations, some have needed to use the portable hoist assembly in small spaces or confined areas. Still others have needed to use the portable hoist assembly in close proximity to a wall. In some applications there has been a need to re-position the windlass assembly for better access by the person turning the crank on the windlass assembly.

Figure 1:
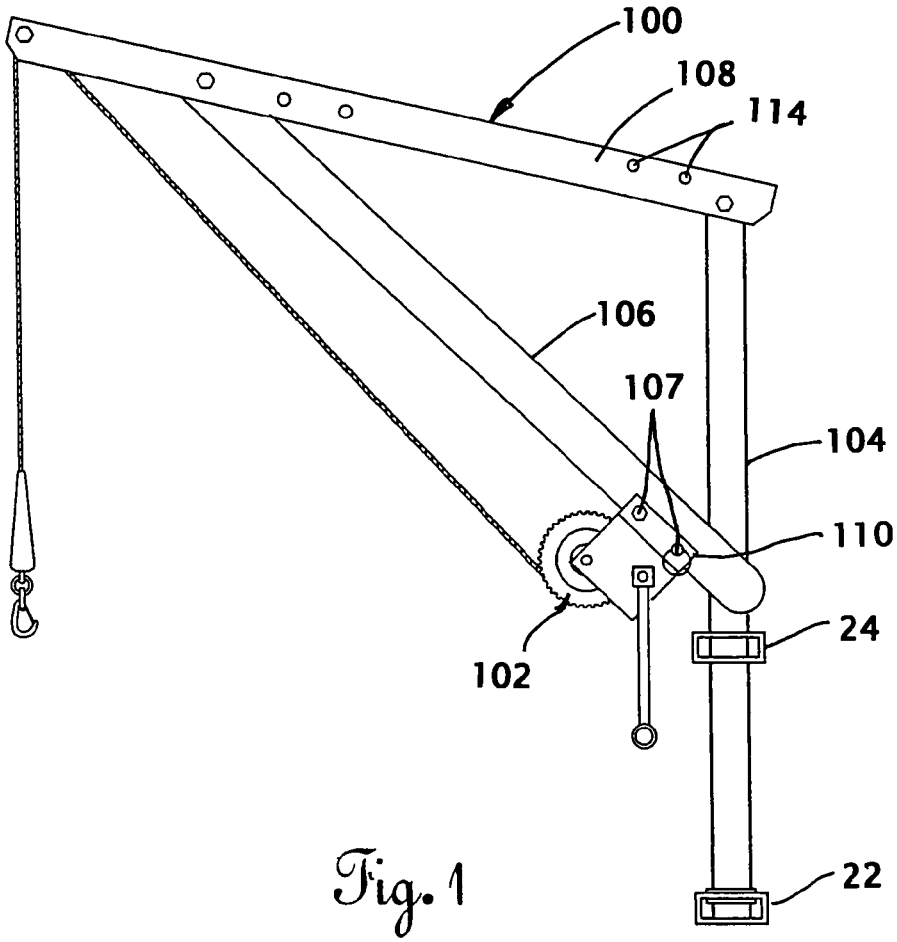
FIG. 1 is a side elevational view of a portable hoist assembly with the windlass assembly mounted on the diagonal brace.
Figure 2:
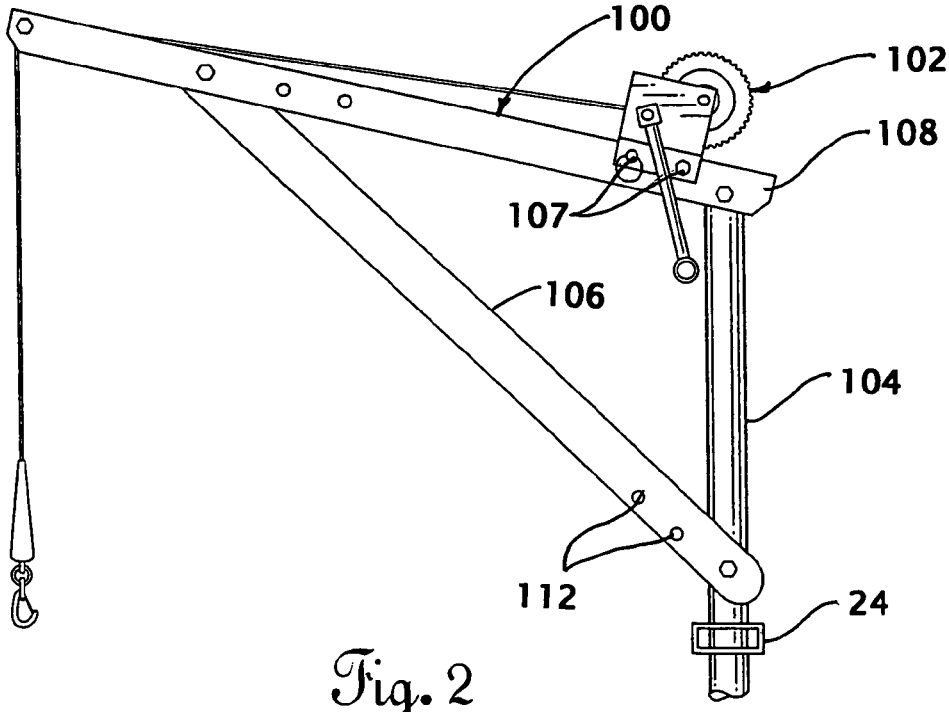
FIG. 2 is a side elevational view of a portable hoist assembly with the windlass assembly mounted on the top support arm.

To respond to those users who have requested a system and method for multiple placements of the windlass assembly 102 from a location on top of the upper support arm 108 shown in FIG. 2, an embodiment has been created wherein the windlass assembly 102 is positionable in other locations on the portable hoist assembly 100. For example, as shown in FIG. 1, the windlass assembly 102 is mounted to the diagonal brace member 106 rather than on the upper support arm 108 as shown in U.S. Pat. No. 6,499,610. The mounting of the windlass assembly 102 is positioned on the diagonal brace member 106 using two removable pins 107 which pass through the sides of a channel section 110 under the windlass assembly 102 and through two holes 112 formed in the diagonal brace member 106 as shown in FIG. 2.

When users have needed to place the windlass assembly 102 on top of the upper support arm 108, the windlass assembly 102 may be moved and mounted to the upper support arm 108 by passing the removable pins 107 through holes in the channel section 110 and through the holes 114 in the support arm 108 shown in FIG. 1.

Figure 3:
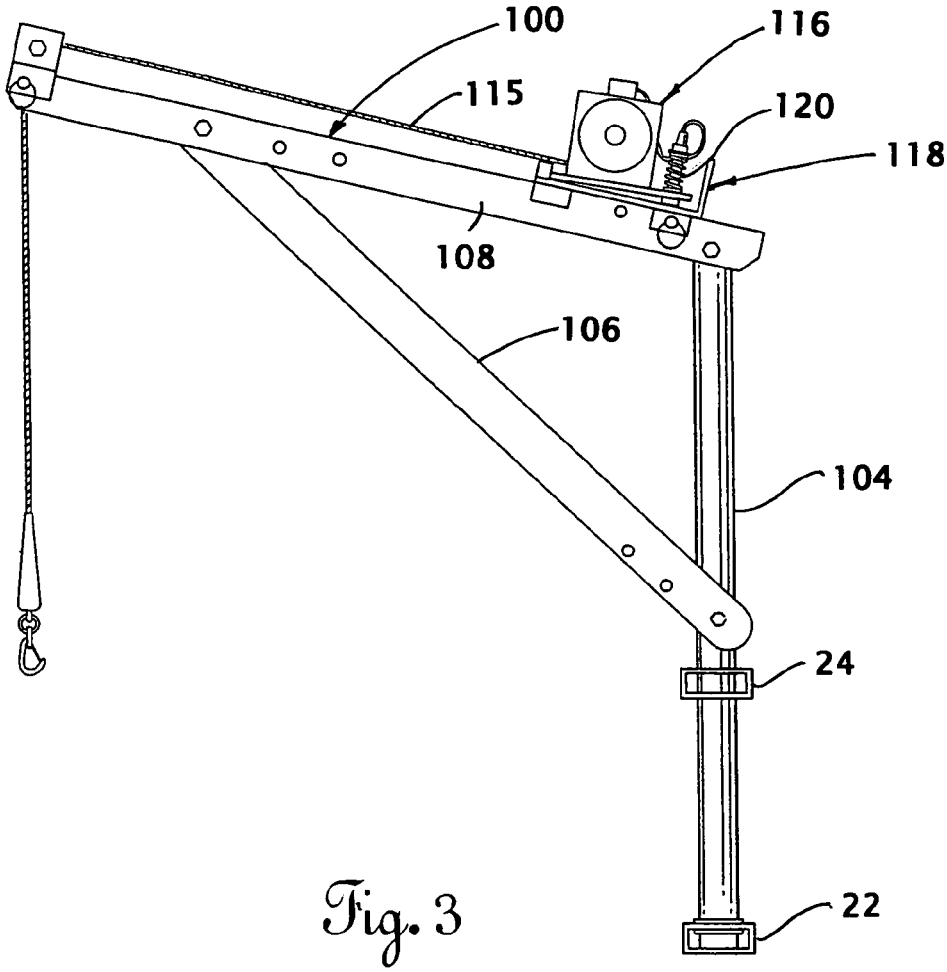
FIG. 3 is a side elevational view of a portable hoist assembly with a motorized windlass or winch assembly mounted on the top support arm.
Figure 4:
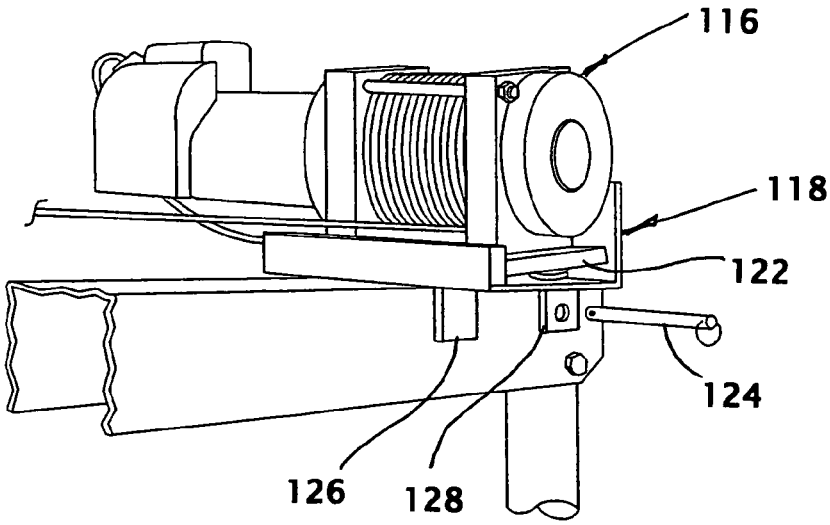
FIG. 4 is an enlarged perspective view of the motorized windlass or winch assembly mounted on the top support arm.

Some users have preferred to use an electric motor driven windlass or winch assembly 116 as shown in FIG. 3 wherein an electric motor driven windlass or winch assembly 116 is positioned on the upper support arm 108. As shown in FIG. 3 and FIG. 4, the mounting assembly 118 for the electric motor driven windlass or winch assembly 116 may include a spring bias 120. Therein the electric motor driven windlass or winch assembly 116 is mounted to a pivotable base 122. Movement of the pivotable base 122 compresses the spring 120 positioned at the opposite end of the base 122 from where the cable 115 comes off the windlass or winch assembly 116. In FIG. 4, the mounting assembly 118 for the electric motor driven windlass or winch assembly 116 to the upper support arm 108 with a removable pin 124 is shown. The mounting base 118 has a first set of guide flanges 126 and a second set of guide flanges 128. The first set of guide flanges 126 is located on the front and the second set of guide flanges 128 is located on the rear of the mounting assembly 118, to align the mounting assembly 118 with the upper support arm 108 as shown in FIGS. 3 and FIG. 4.

Still other users have found a significant utility in the portable hoist system described in U.S. Pat. No. 6,499,610 or in FIGS. 1, 2, 3 and 4 for lifting loads onto the roof of a building as depicted in the embodiment of the mounting system and method shown in FIG. 5 and FIG. 6.

Figure 5:
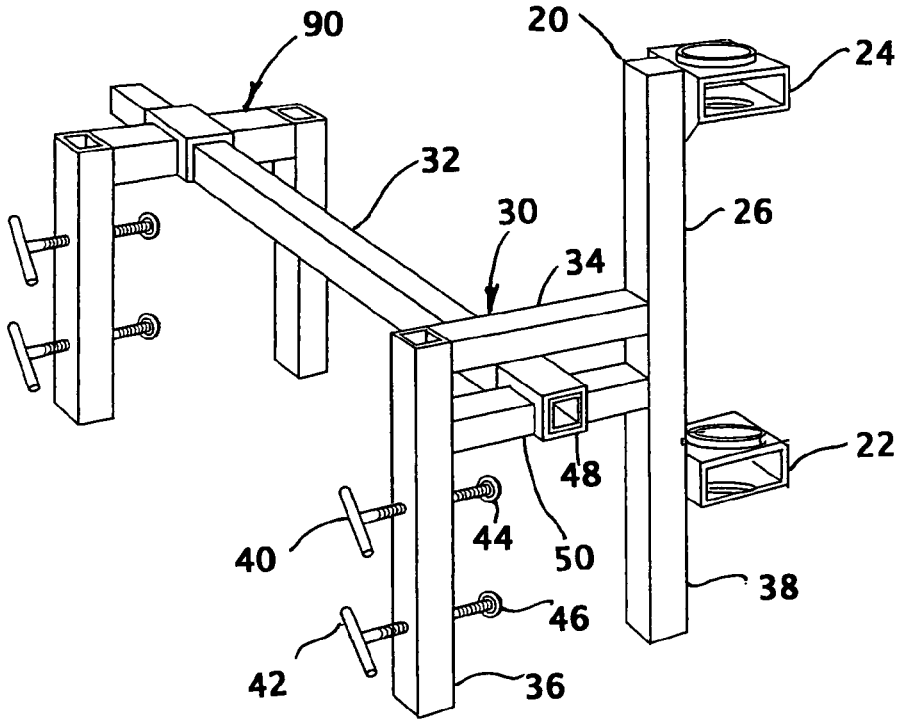
FIG. 5 is a perspective view of the saddle mount assembly for the portable hoist assembly.

As shown in FIG. 5, the mounting holster 20 for the substantially vertical support 104 for the portable hoist assembly 100 includes two aligned circular guides 22, 24 affixed to a substantially vertical section of square tubing 26. The mounting holster 20 is affixed to a stand-alone saddle mount assembly 30 which contacts the front side 134 and the back side 132 of the wall 130 bordering the roof of the building. A turn over support brace 32 which is slidably positionable with respect to the stand-alone saddle mount assembly 30 and which lays along the top 136 of the wall 130 bordering the roof of the building keeps the portable hoist assembly 100 from turning over when lifting a load.

Figure 6:
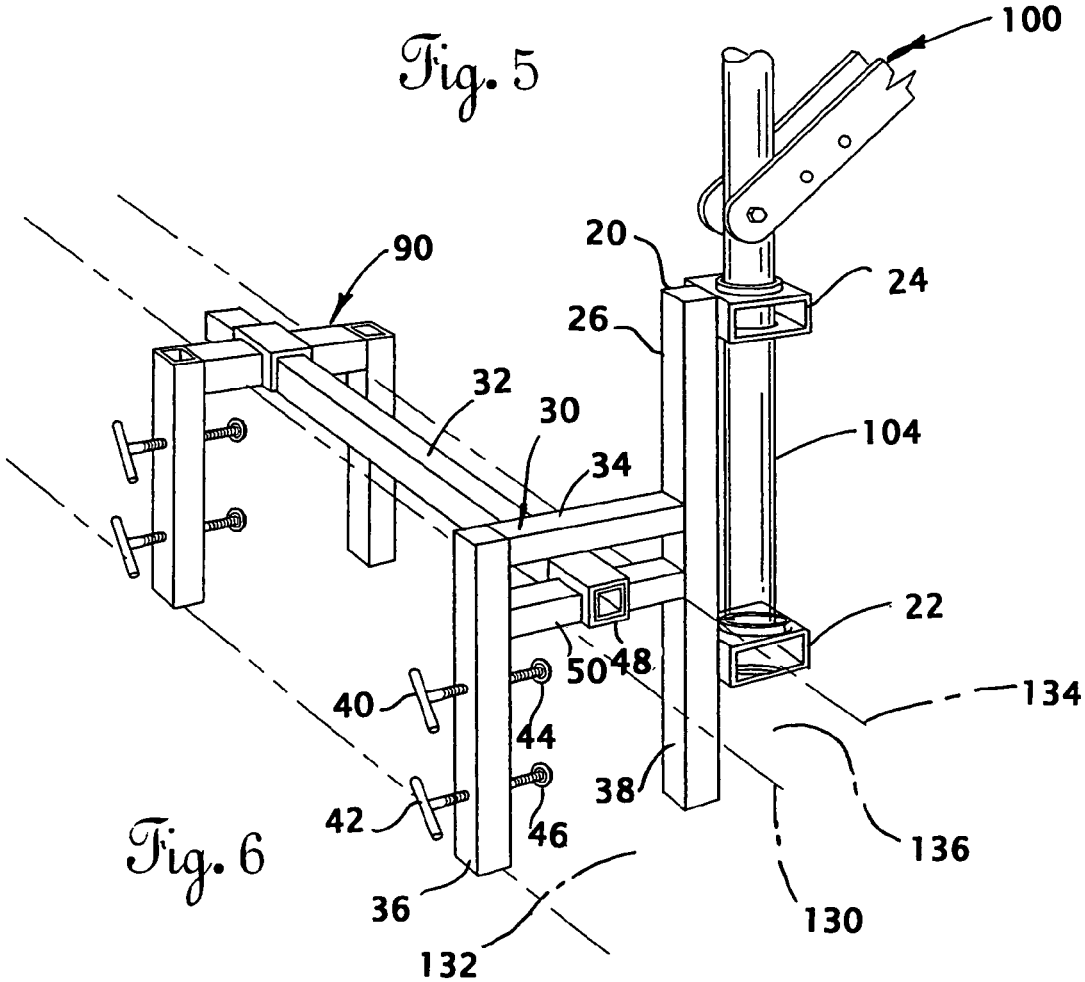
FIG. 6 is a perspective view of the saddle mount assembly shown in FIG. 5 positioned on the top of a wall and including a portable hoist assembly.

In FIG. 6, looking outward from the top of the roof, the substantially vertical support 104 for the portable hoist assembly 100 is shown inserted into the mounting holster 20. The stand-alone saddle mount assembly 30, formed as in an upside down U shape, straddles the top 136 of the wall 130. Specifically, a first cross bar 34 passes over the top 136 of the wall 130. Attached to the cross bar 34 is a first substantially vertical member 36 which runs substantially parallel to the back side 132 of the wall 130 and a second substantially vertical member 38 which runs substantially parallel to the front side 134 of the wall 130. In the preferred embodiment shown in FIG. 5 and in FIG. 6 the vertical section of square tubing 26 in the mounting holster 20 and the second substantially vertical member 38 are formed as one. Alternatively, the vertical section of square tubing 26 could be welded to the second substantially vertical member 38.

Through the first substantially vertical member 36 of the stand-alone saddle mount assembly 30 pass two threaded fasteners 40, 42. The threadable engagement of the threaded fasteners 40, 42 with the first substantially vertical member 36 causes the fasteners 40, 42 to move through the first substantially vertical member 36 when turned. Each of the threaded fasteners 40, 42 has a foot 44, 46 which contacts the back side 132 of the wall 130 to secure the saddle mount assembly 30 to the wall 130.

The turn over support brace 32 is shown extending along the top 136 of the wall 130. The turn over support brace 32 is connected to the stand-alone saddle mount assembly 30 by sliding it through an open section of tubing 48 positioned in a second cross bar 50 which is connected to the first and second substantially vertical members 36, 38. The stand-alone saddle mount assembly 30 is adjustable to accommodate walls of varying thicknesses. Tightening of the fasteners 40, 42 holds the saddle mount assembly 30 in place against the wall 130 thereby providing a secure support for the mounting holster 20. As previously indicated, the turn over support brace 32 slides into a tubular opening 48 in a second cross member 50 in the stand-alone saddle mount assembly 30 to prevent the stand-alone saddle mount assembly 30 from turning over in response to a moment from lifting a load. If desired, a second stand-alone optional saddle mount assembly 90 similar to stand-alone saddle mount assembly 30 may be used on the end of the turn over support brace 32. And, if desired, a second turn over support brace (not shown) may be used to extend from the opposite side of the stand-alone saddle mount assembly 30 and a third optional saddle mount assembly (not shown) may be placed on the end of the second turn over support brace. Those of ordinary skill in the art will understand that stand-alone saddle mount assemblies may be made in a variety of different sizes so that they may also be affixed to the side of a dumpster, an I-beam or most any shape rigid beam.

Figure 7:
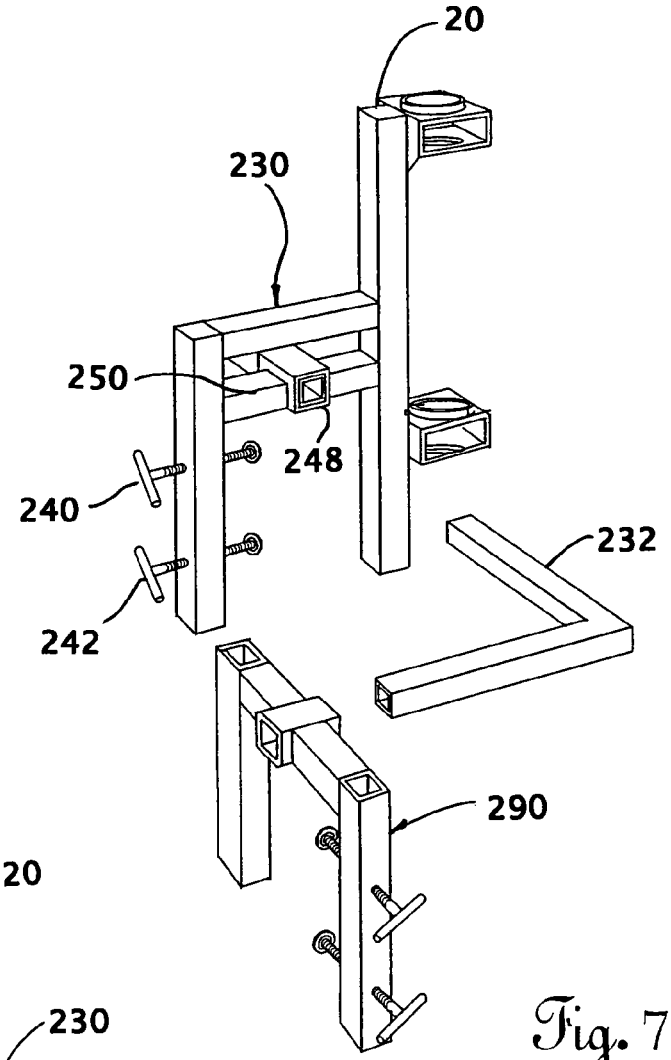
FIG. 7 is a perspective view of a disassembled saddle mount assembly for use on a corner formed by two wall sections.
Figure 8:
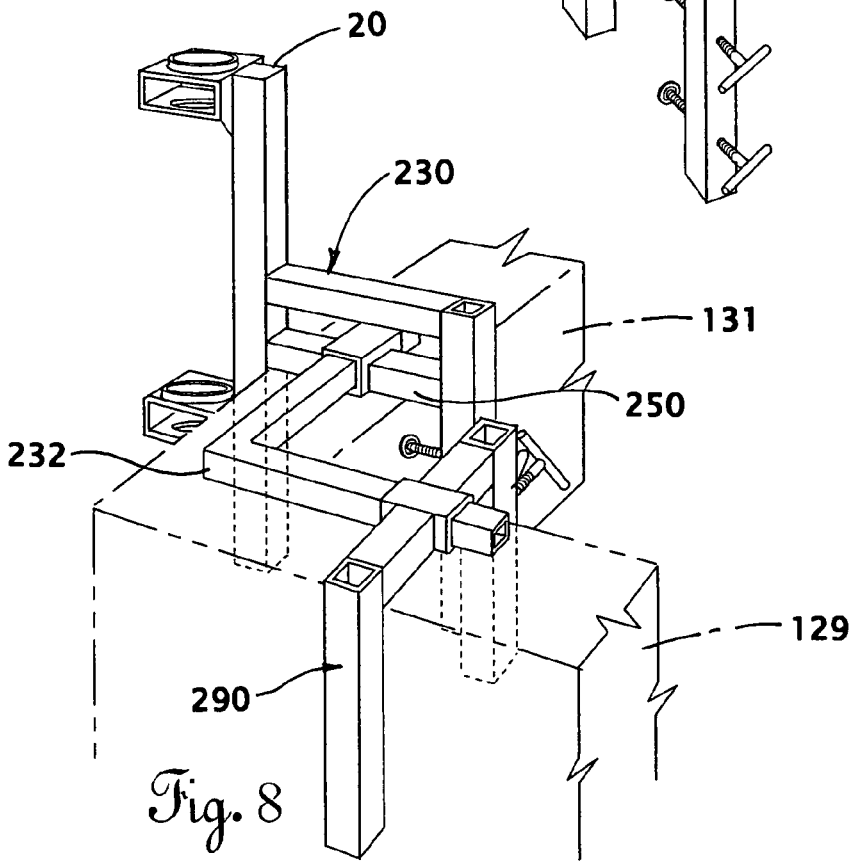
FIG. 8 is a perspective view of the saddle mount assembly shown in FIG. 7 but in its assembled configuration.

As shown in FIG. 7 and FIG. 8, the stand-alone saddle mount assembly 30 as shown in FIG. 5 and in FIG. 6 may be adapted for use at the corner formed by two wall sections 129, 131 wherein a first stand-alone saddle mount assembly 230 similar to the stand-alone saddle mount assembly 30 shown in FIG. 5 and FIG. 6 is placed over one wall section near where the wall sections 129, 131 come together at a corner. In FIG. 7, the stand-alone saddle mount assembly 230 for use at the corner of a building is shown together with an angled turn over support brace 232 formed from two pieces of tubing welded together to from a right angle and slidably inserted into stand-alone saddle mount assembly 230. Also shown is a second stand-alone optional saddle mount assembly 290 similar in construction to stand-alone saddle mount assembly 230 to secure the opposite end of the angled turn over support brace 232.

Those of ordinary skill in the art will understand that where the wall sections of a building do not come together at a right angle, two pieces of tubing may be welded together at whatever angle is formed by the corner of the building to form a turnover support brace. As shown in FIG. 7 and FIG. 8, the fasteners 240, 242 are tightened to contact the back surface 132 of the building wall 130. The opening 248 in the cross piece 250 allows for insertion of the angled support piece 232. The mounting holster 20 formed as part of the first saddle mount assembly 230 allows for insertion of the substantially vertical support 104 of the portable hoist assembly 100.

Figure 9:
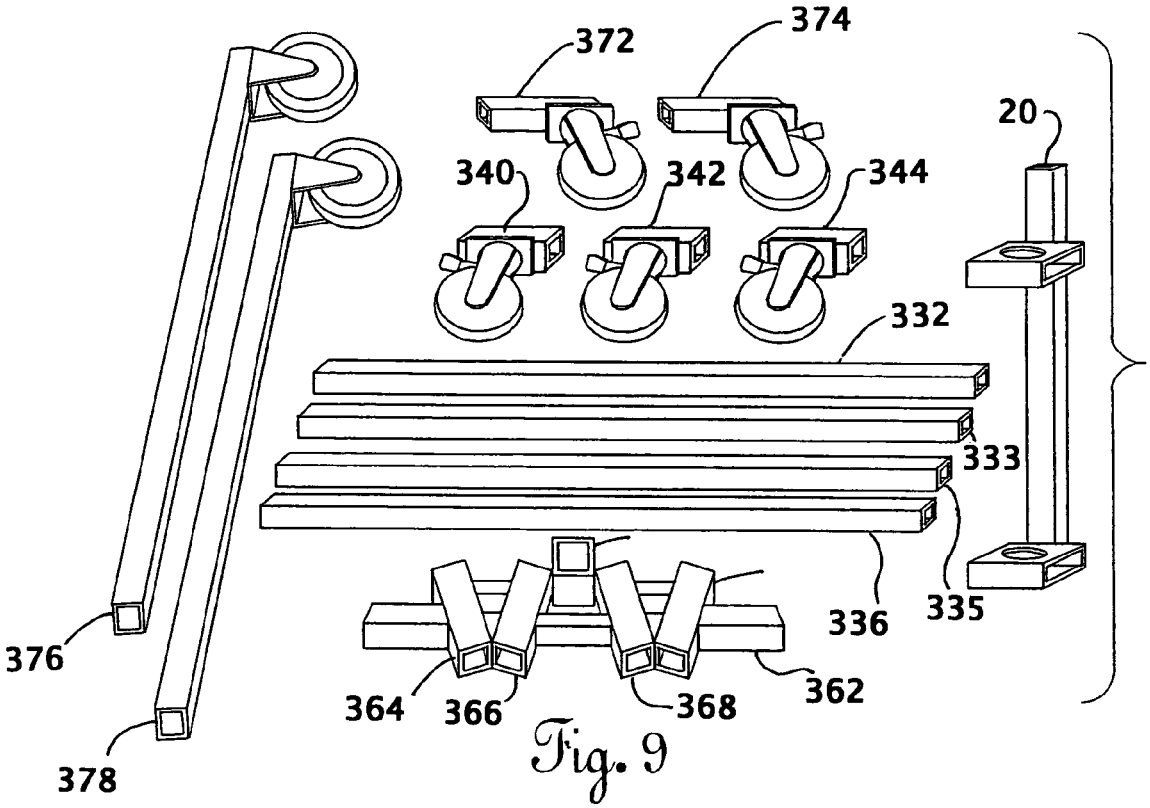
FIG. 9 is a perspective view of an array of pieces from which a base for floor support of a portable hoist assembly may be made.
Figure 10:
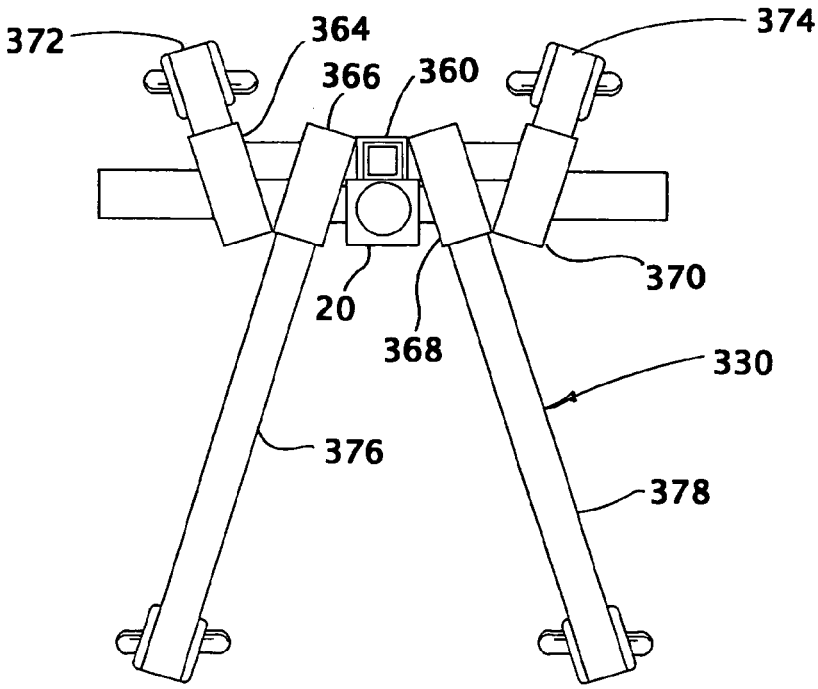
FIG. 10 is a top plan view of a first arrangement of a floor supported base.
Figure 11:
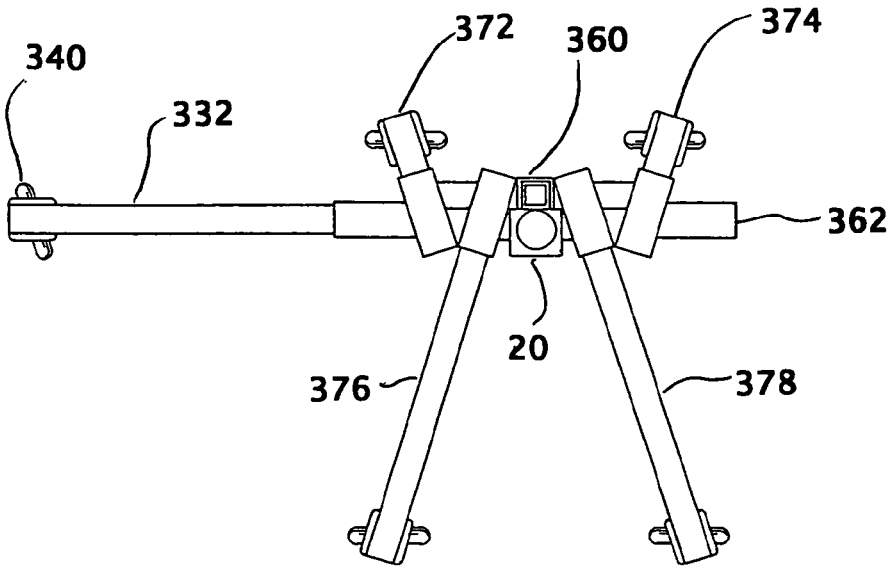
FIG. 11 is a top plan view of a second arrangement of a floor supported base.
Figure 12:
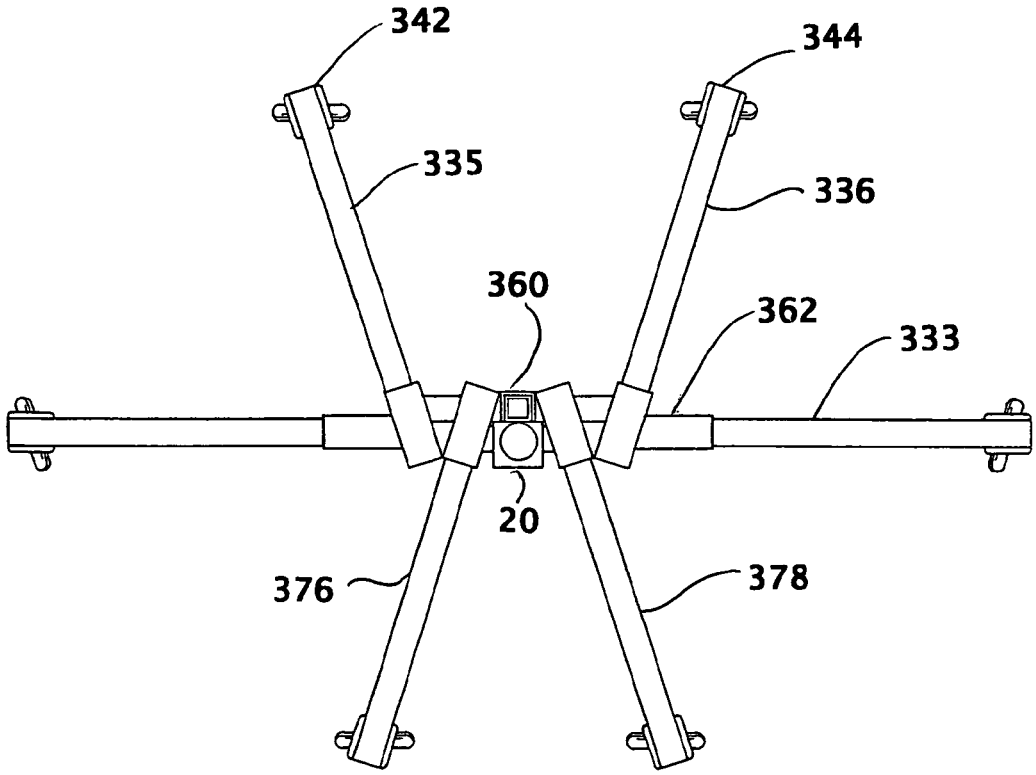
FIG. 12 is a top plan view of a third arrangement of a floor supported base.

Yet other users have needed a small stationary platform or a small movable platform to be used when the portable hoist is not mounted to a vehicle, a trailer or a building. The pieces of the small stationary platform or small movable platform for use with the portable hoist assembly described in U.S. Pat. No. 6,499,610 or in FIGS. 1, 2, 3, and 4 are shown in FIG. 9. In FIG. 10 a first arrangement 330 of some of the pieces shown in FIG. 9 is shown. The mounting holster 20 is slid into a substantially vertical receptacle 360 attached to a hollow base bar 362. Also attached to the hollow base bar 362 are substantially horizontal angled receptacles 364, 366, 368, and 370. Slid into the receptacles 364 and 370 are two short wheel assemblies 372, 374. Slid into receptacles 366 and 368 are two long wheel assemblies 376 and 378. If a turn over moment in one direction is anticipated a first support brace 332 may be inserted into one end of the hollow base bar 362 as shown in FIG. 11. A wheel assembly 340 may be placed in the other end of the of the first turn over support brace 332. If turn over moments in two directions are anticipated, a second turn over support brace 333 may be inserted into the other end of the hollow base bar 362. As in the arrangement shown in FIG. 12, a wheel assembly may be placed at the end of the second turn over support brace 333. Also, if needed, wheel assemblies 372, 374 as shown in FIG. 11, many be replaced with longer turn over support braces 335, 336 with wheel assemblies 342, 344 affixed to their ends.

Figure 13:
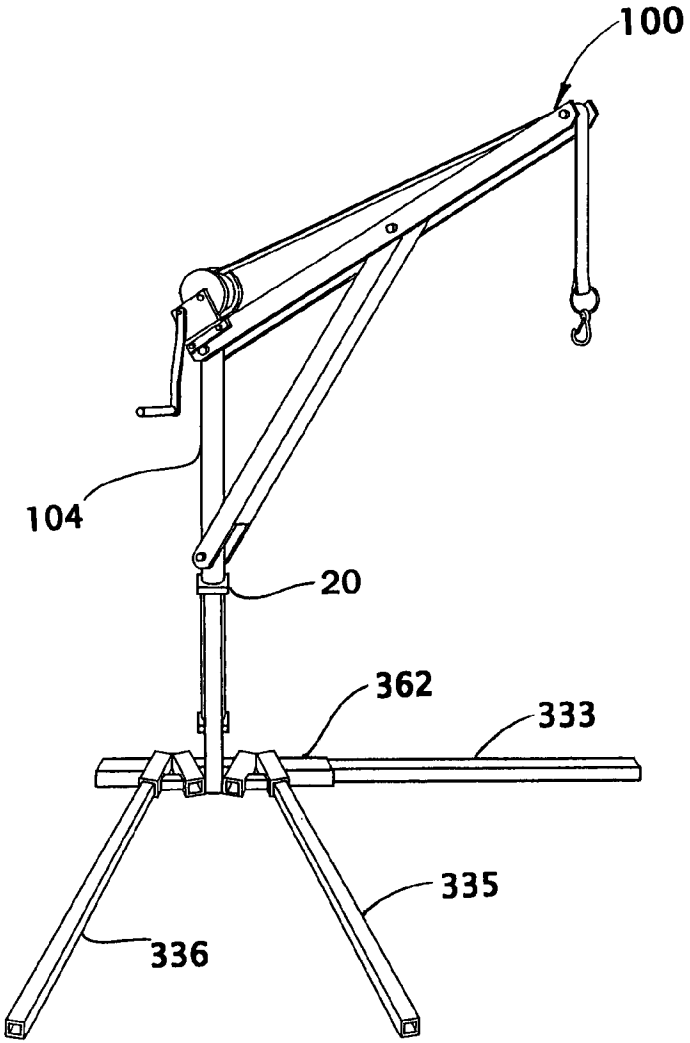
FIG. 13 is a perspective view of a portable hoist assembly mounted to a floor supported base similar to the second arrangement of the base as shown in FIG. 11.

If desired, the wheel assemblies may be eliminated as shown in FIG. 13.

Figure 14:
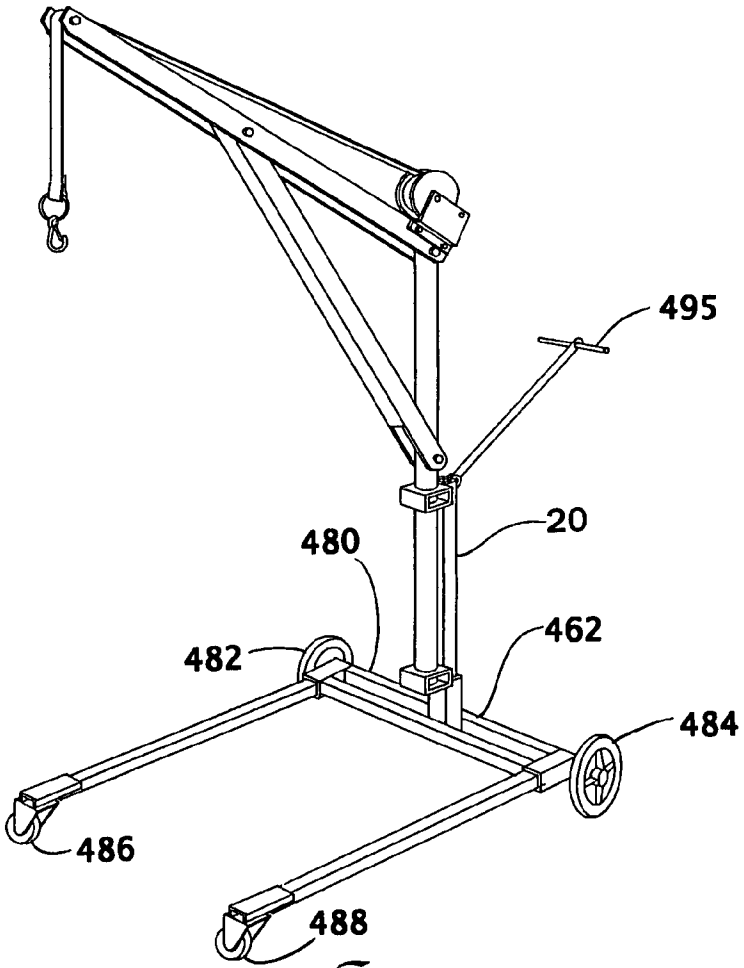
FIG. 14 is a perspective view of a floor supported base configured as a substantially U shaped cart.

In FIG. 14, the mounting holster 20 is shown mounted to base bar assembly 462 which forms the base of a substantially U shaped wheeled portable cart or platform 480. Wheel assemblies 482, 484, 486, 488 are mounted on either end of the base bar assembly 462 and on the end of the arms 464, 466 which extend outwardly from the base bar assembly 462. The portable hoist assembly 100 is positioned over the open portion of the substantially U shaped wheeled portable cart 480 to resist any turn over moment. Once a load has been lifted, the load may be moved together with the portable hoist assembly 100, and the wheeled portable cart 480 by applying force to the handle 495.

While the systems and methods of the present invention have been illustrated according to preferred embodiment, those of ordinary skill in the art will understand that other embodiments have been enabled. Such other embodiments shall be included within the scope and meaning of the appended claims.

What is claimed is:

1. A system for securing a mounting holster for a portable hoist assembly, said system being suitable for use on the top of two wall sections forming a corner, said system comprising:

a first stand-alone saddle mount assembly constructed and arranged to straddle the top of the wall section on one side of the corner;

an angled turn over support brace slidably positionable with respect to said first stand-alone saddle amount assembly and constructed and arranged for resting on the top of the wall sections which form the corner to prevent the first stand-alone saddle mount assembly from turning over during the lifting of a load.

2. The system as defined in claim 1 further including a second stand-alone saddle mount assembly slidably positionable with respect to said angled turn over support brace.

3. The system as defined in claim 1 wherein said first saddle stand-alone mount assembly includes:

a first cross member;

a first substantially vertical member depending downwardly from one end of said cross member;

a second substantially vertical member depending downwardly from the opposite end of said first cross member.

4. The system as defined in claim 3 further including a second cross member substantially parallel to said first cross member including a receptacle for slidably positioning said angled turn over support brace.

* * * * *